US005295783A

United States Patent [19]

Lesko et al.

[11] Patent Number: 5,295,783

[45] Date of Patent: Mar. 22, 1994

[54] SYSTEM AND METHOD FOR REGULATING THE SPEED OF A STEAM TURBINE BY CONTROLLING THE TURBINE VALVE RACK ACTUATOR

[75] Inventors: Frederick H. Lesko, Lehighton; Charles A. Parker, Saylorsburg, both of Pa.

[73] Assignee: Conmec, Inc., Bethlehem, Pa.

[21] Appl. No.: 49,797

[22] Filed: Apr. 19, 1993

[51] Int. Cl.[5] ..... F01D 17/06

[52] U.S. Cl. ..... 415/30; 415/36; 415/43; 60/413

[58] Field of Search ..... 415/30, 36, 39, 40, 415/41, 42, 43, 1; 60/413

[56] References Cited

U.S. PATENT DOCUMENTS

| | | | |
|---|---|---|---|
| 2,440,980 | 5/1948 | Sheppard | 60/1 |
| 2,956,502 | 10/1960 | Glaser et al. | 103/87 |
| 3,087,434 | 4/1963 | Reichenbacher | 103/87 |
| 3,623,573 | 11/1971 | Csanady, Jr. | 184/36 R |
| 3,728,857 | 4/1973 | Nichols | 60/36 |
| 3,817,651 | 6/1974 | Law et al. | 415/30 |
| 3,859,007 | 1/1975 | Kowalski et al. | 415/30 |
| 3,986,788 | 10/1976 | Rossi | 415/30 |
| 4,015,430 | 4/1977 | Braytenbah et al. | 415/30 |
| 4,121,424 | 10/1978 | Sato et al. | 415/30 |
| 4,339,226 | 7/1982 | Lee | 415/43 |
| 4,446,377 | 5/1984 | Kure-Jensen et al. | 290/52 |
| 4,629,033 | 12/1986 | Moore et al. | 184/6.3 |
| 4,899,850 | 2/1990 | Köller | 184/6.3 |
| 4,969,562 | 11/1990 | Saotome | 60/413 |
| 5,060,475 | 10/1991 | Latimer | 60/413 |
| 5,197,787 | 3/1993 | Matsuda et al. | 60/413 |
| 5,209,317 | 5/1993 | Schnelle | 60/413 |

FOREIGN PATENT DOCUMENTS

| | | | |
|---|---|---|---|
| 270748 | 8/1970 | U.S.S.R. | 415/30 |
| 382828 | 8/1973 | U.S.S.R. | 415/30 |
| 2079987 | 1/1982 | United Kingdom | 415/36 |

*Primary Examiner*—John T. Kwon

*Attorney, Agent, or Firm*—Joseph J. O'Keefe; Charles A. Wilkinson

[57] ABSTRACT

A system and method for regulating the speed of a steam turbine by operating a steam valve rack assembly to adjust the flow of steam to the turbine by controlling the position of the turbine valve rack actuator in response to high pressure oil fed, reacting to signals from a speed control system, through a proportional valve to the valve rack actuator. High pressure oil is fed to the proportional valve from a hydraulic oil accumulator, charged with an inert gas, in which high pressure oil is stored. A source of low pressure oil directed to a pressure intensifying device increases the oil pressure to a high pressure and circulates the high pressure oil to the hydraulic oil accumulator and the proportional valve to stroke the turbine valve rack actuator in response to signals from the speed control system. The system further includes an emergency stop valve system which operates to close the turbine valve rack assembly very rapidly in the event of a serious turbine condition.

20 Claims, 1 Drawing Sheet

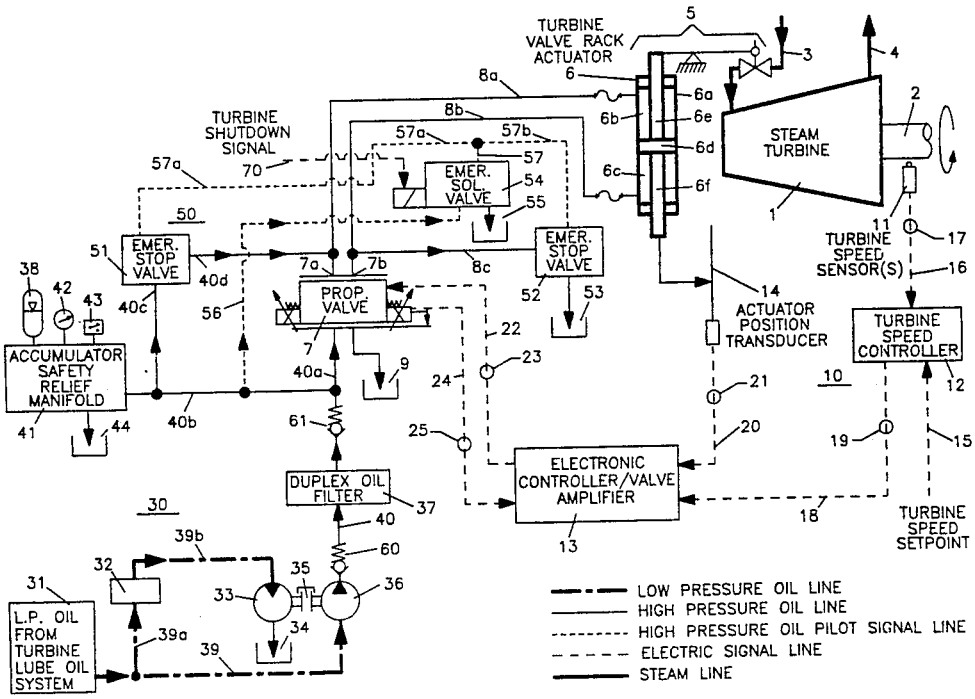

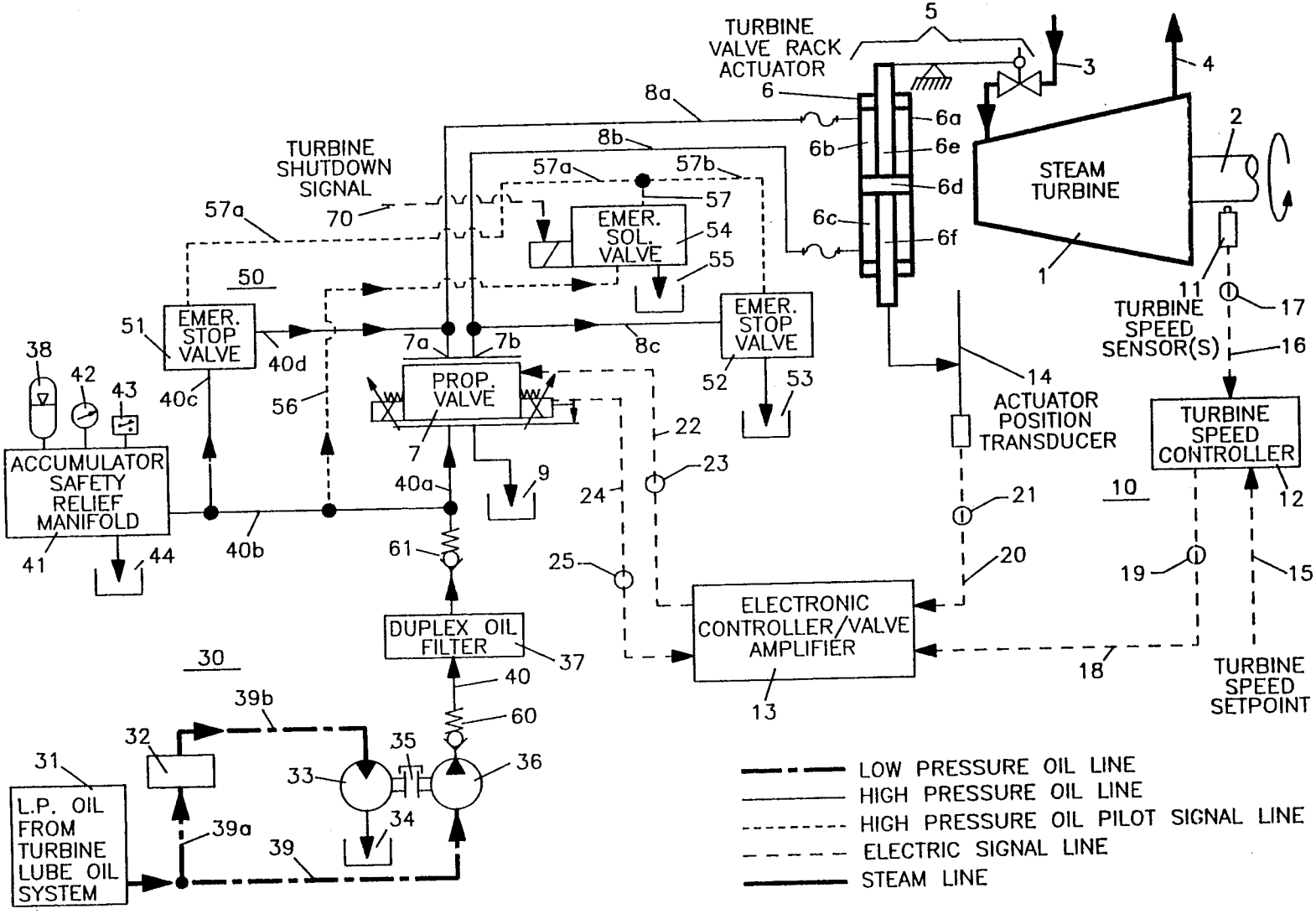
STEAM TURBINE
TURBINE SPEED SENSOR(S)
TURBINE SPEED CONTROLLER
TURBINE SPEED SETPOINT
ACTUATOR POSITION TRANSDUCER
ELECTRONIC CONTROLLER/VALVE AMPLIFIER
TURBINE VALVE RACK ACTUATOR
EMER. STOP VALVE
EMER. SOL. VALVE
PROP. VALVE
DUPLEX OIL FILTER
TURBINE SHUTDOWN SIGNAL
ACCUMULATOR SAFETY RELIEF MANIFOLD
L.P. OIL FROM TURBINE LUBE OIL SYSTEM
LOW PRESSURE OIL LINE
HIGH PRESSURE OIL LINE
HIGH PRESSURE OIL PILOT SIGNAL LINE
ELECTRIC SIGNAL LINE
STEAM LINE

SYSTEM AND METHOD FOR REGULATING THE SPEED OF A STEAM TURBINE BY CONTROLLING THE TURBINE VALVE RACK ACTUATOR

FIELD OF THE INVENTION

This invention relates to an improved system and method for regulating the speed of a steam turbine by controlling the position of the steam valve rack actuator. More particularly, the system and method are applicable to use of low pressure oil in conjunction with pressure amplification means and an accumulator to provide high pressure oil on demand to control the position of a steam turbine valve rack actuator to regulate the speed of a turbine.

BACKGROUND OF THE INVENTION

Systems which provide a flow of high pressure hydraulic oil to control the position of a steam turbine valve rack actuator assembly are known. One type of such a system employs separate dedicated hydraulic power unit modules consisting of: a separate reservoir source of hydraulic oil, along with all the necessary oil storage appurtenances; independent power source or sources; separate prime movers to drive the hydraulic pumps; electric motor controls and starters; and oil coolers to maintain the oil systems' temperature. The disadvantages of the dedicated hydraulic power unit modules system are: higher initial capital investment, higher energy consumption, increased maintenance, and a requirement for additional floor space for mounting the hydraulic power unit module.

Another prior art system commonly pressurizes the lubrication supply system pressure to that required of the turbine's valve rack actuator. In such other system, the elevated oil pressure must then be reduced to the pressure of the lubrication oil supply, which is significantly lower than the valve rack actuator oil pressure. The pressure reduction is typically accomplished by a pressure reducing control regulator which converts a large portion of the energy of the higher pressure oil into heat and noise. The disadvantages of this type of system are that it is inefficient and consumes an excessively higher amount of energy, operates at increased noise levels, and requires higher maintenance resulting in reduced equipment life due to continuous higher operating pressures at full flow running conditions.

An example of a system which provides a flow of high pressure hydraulic oil to control the position of a steam turbine valve rack actuator assembly is described in U.S. Pat. No. 2,440,980.

OBJECTS OF THE INVENTION

It is the main object of this invention to provide a system and method for furnishing the required amount and pressure of oil to a steam turbine valve rack actuator in an economical and efficient manner to regulate the turbine speed without the disadvantages of the above mentioned prior art systems.

Another object of the invention is to provide a system for establishing a torque match between a low pressure, high flow hydraulic motor and a high pressure, low flow hydraulic pump to charge the actuator high pressure oil supply system. This system, when fully charged, stalls thereby conserving energy and reducing component wear.

Another object of the invention is to provide a system which limits the speed and flow of oil from the low pressure oil source during low turbine load such as experienced at start-up and also during a coupling failure.

An additional object of the invention is to provide a system for rapidly closing a steam turbine's valve rack actuator in response to emergency situations as, for example, prevention of turbine overspeed in response to rapid loss of load resulting from a generator tripping off-line at full power, in the case of a turbine-generator set.

SUMMARY OF THE INVENTION

The system of this invention regulates the speed of a steam turbine by operating a steam valve rack assembly to adjust the flow of steam to the turbine by controlling the position of the turbine valve rack actuator in response to oil within a first pressure range fed, reacting to signals from a speed control system, through a proportional valve to the valve rack actuator. The system comprises a source of oil within a second pressure range lower than the first pressure range, an oil accumulator, and pressure intensifying means, e.g. a hydraulic motor coupled to a hydraulic pump, arranged to receive oil within the second pressure range from the oil source, increase the pressure thereof to within the first pressure range, and circulate the oil within the first pressure range to the accumulator and the proportional valve. Oil within the first pressure range passes from the accumulator and through the proportional valve to the turbine valve rack actuator to open or close the valve rack assembly to reduce or increase the flow of steam to the turbine in response to signals from the closed loop speed control system.

In another variation of the system of this invention the turbine valve rack actuator control system further includes an emergency stop valve system which operates to close the turbine valve rack assembly very rapidly in the event of one or more serious turbine conditions. The emergency stop valve system comprises first and second emergency stop valves and an emergency solenoid valve. One side of the emergency solenoid valve connects with the valve rack actuator control system accumulator and another side of the emergency solenoid valve connects with the first and second emergency stop valves. When activated in response to an external signal, the emergency solenoid valve operates to dump pilot oil maintained within the first pressure range from the first and second emergency stop valves to an oil drain. This permits the emergency stop valves to open causing oil within the first pressure range to flow through the first emergency stop valve to the first side of the valve rack actuator and oil within the first pressure range to drain from the second side of the valve rack actuator through the second emergency stop valve. This action closes the valve rack actuator and valve rack cutting off the steam supply to the turbine.

The method of the invention is applicable to a system for regulating the speed of a steam turbine by operating a steam valve rack assembly to adjust the flow of steam to the turbine by controlling the position of the turbine valve rack actuator in response to oil within a first pressure range fed, reacting to signals from a closed loop speed control system, through a proportional valve to the valve rack actuator. The method comprises the steps of increasing the pressure of oil from a low pressure source to a high pressure by use of a pressure amplification assembly, delivering the high pressure oil to an accumulator which is pressurized with inert gas for storage therein, and releasing, on demand, at least a portion of the high pressure oil stored in the accumulator to the proportional valve and from there to the valve rack actuator to adjust the position thereof to reduce or increase the flow of steam to the turbine to control the speed thereof when a signal from the closed loop speed control system calls for a change in the speed of the turbine.

BRIEF DESCRIPTION OF THE DRAWING

The nature of the invention will be more clearly understood by reference to the following description, the appended claims, and the schematic diagram of the invention in the accompanying drawing.

DESCRIPTION OF THE PREFERRED EMBODIMENT

Referring to the drawing there is shown turbine 1 having an output shaft 2, steam inlet conduit 3, and turbine discharge conduit 4. The flow of steam from inlet conduit 3 to turbine 1 is controlled by valve rack assembly 5 which is regulated by valve rack actuator 6. Valve rack actuator 6 includes cylinder 6*a*, cylinder upper end portion 6*b*, cylinder lower end portion 6*c*, piston 6*d*, and piston rod upper portion 6*e* and lower portion 6*f*. Piston rod upper portion 6*e* connects at its inner end with the upper face of piston 6*d*, extends through cylinder upper end portion 6*b*, and connects at its outer end with steam turbine valve rack assembly 5. Piston rod lower portion 6*f* connects at its inner end with the lower face of piston 6*d*, extends through cylinder lower end portion 6*c* and connects at its outer end with actuator position transducer 14 which responds to the position of actuator 6, as is further described below. Operation of turbine valve rack actuator 6 is controlled by proportional valve 7 having ports 7*a* and 7*b*. Oil conduit 8*a* connects proportional valve port 7*a* with turbine valve rack actuator cylinder upper end portion 6*b*, and oil conduit 8*b* connects proportional valve port 7*b* with turbine valve rack actuator cylinder lower end portion 6*c*. Oil drains through proportional valve 7 and oil drain 9.

Turbine 1 includes closed loop speed control system 10 comprising speed sensor 11, speed controller 12, electronic controller/valve amplifier 13, actuator position transducer 14, and signal line 15 which connects with speed controller 12 and transmits a signal from an external source, not shown, to speed controller 12 to establish the desired turbine speed. Signal line 16 extends between speed sensor 11 and speed controller 12, and turbine speed feedback signal, illustrated graphically as 17, is transmitted through signal line 16. Signal line 18 extends from turbine speed controller 12 to electronic controller/valve amplifier 13 and actuator position command signal, illustrated graphically as 19, is transmitted through signal line 18. Signal line 20 extends from actuator position transducer 14 to electronic controller/valve amplifier 13, and actuator position feedback signal, illustrated graphically as 21, is transmitted through signal line 20. Signal line 22 extends from electronic controller/valve amplifier 13 to proportional valve 7 and transmitted through such line is valve position command signal, illustrated graphically as 23. Extending from proportional valve 7 to electronic controller/valve amplifier 13 is signal line 24 and transmitted through such line is valve position feedback signal, illustrated graphically as 25. The above described closed loop speed control system 10 is typical of that used for many turbines.

The flow of oil to proportional valve 7 is provided by turbine valve rack actuator control system 30 which comprises a source 31 of low pressure oil of between 20 psig and 200 psig and, preferably, between 120 psig and 160 psig, velocity fuse 32, hydraulic motor 33, hydraulic pump 36 which increases the low oil pressure to a high pressure, i.e. between 600 psig to 2000 psig and preferably between 1000 psig and 1500 psig, duplex oil filter 37, and hydraulic oil accumulator 38. Oil drains through hydraulic motor 33 to oil drain 34. Hydraulic motor 33 connects with hydraulic pump 36 by means of coupling 35, and the three elements collectively comprise pressure amplification means, not numbered.

Conduit 39 connects low pressure oil source 31 with oil conduit 39*a*, which connects with velocity fuse 32, and oil conduit 39*b* extends between velocity fuse 32 and hydraulic motor 33. Oil conduit 39 also connects with hydraulic pump 36. Extending between hydraulic pump 36 and duplex filter 37 is high pressure oil conduit 40 in which check valve 60 is mounted after hydraulic pump 36. Extending between duplex filter 37 and proportional valve 7 is high pressure oil conduit 40*a* in which check valve 61 is mounted after duplex filter 37. Between duplex filter 37 and proportional valve 7 and after check valve 61 high pressure oil conduit 40*b* branches off high pressure oil conduit 40*a*. Oil conduit 40*b* connects with accumulator safety relief manifold 41 which connects with hydraulic oil accumulator 38, pressure gauge 42, and pressure switch 43. Oil drains through accumulator safety relief manifold 41 and oil drain 44.

Associated with turbine 1, turbine speed control system 10 and turbine valve rack actuator control system 30 is emergency stop valve system 50. System 50 operates to close turbine valve rack assembly 5 very rapidly, i.e. within 0.2 and 0.5 seconds, in the event of a turbine over-speed condition that may be initiated by an instantaneous turbine load loss due to coupling failure or a generator breaker opening in the case of a turbine-generator upset. Emergency stop valve system 50 comprises emergency stop valves 51 and 52 and emergency solenoid valve 54. High pressure oil conduit 40*c* extends from high pressure oil conduit 40*b* and connects with emergency stop valve 51. High pressure oil conduit 40*d* extends from emergency stop valve 51 and connects with oil conduit 8*a* which in turn connects with steam turbine valve rack actuator upper end portion 6*b*. High pressure oil pilot line 56 extends from high pressure oil conduit 40*b* and connects with one side of emergency solenoid valve 54. High pressure oil pilot line 57 extends from a second side of emergency solenoid valve 54 and branches into oil pilot line 57*a* that connects with emergency stop valve 51 and oil pilot line 57*b* that connects with emergency stop valve 52. Oil conduit 8*c* extends from oil conduit 8*b*, just after port 7*b* of proportional valve 7, to emergency stop valve 52. Oil drains through emergency stop valve 52 and oil drain 53, and oil drains through emergency solenoid valve 54 and oil drain 55. Signal line 70 extends from emergency solenoid valve 54 to a control source, not identified, which sends a signal through such line to trigger the operation of valve 54 in the event of an emergency.

The system of the preferred embodiment of the invention, in conjunction with a 24,000 horse power steam turbine, operates as follows. Oil at a low pressure of between 20 psig and 200 psig from a lubrication oil source 31 passes through low pressure oil conduit 39 and oil conduit 39*a* to velocity fuse 32. Fuse 32 permits passage of oil within an established velocity range or flow rate up to about 20 gallons per minute. If the flow rate exceeds that amount the fuse closes. The low pressure oil flows through fuse 32 and through low pressure oil conduit 39*b* to hydraulic motor 33, which is connected with and drives hydraulic pump 36 through coupling 35. The low pressure oil flowing to hydraulic motor 33 creates rotational energy driving such motor's shaft and coupling and the shaft of hydraulic pump 36.

Pump 36 is primed by low pressure oil flowing through low pressure oil conduit 39 connected to the inlet of hydraulic pump 36. The torque created by hydraulic motor 33 is limited by the low oil pressure, i.e. between 20 psig to 200 psig, and the volumetric displacement of such motor. Hydraulic pump 36 may be piston, gear or vane type, which by virtue of its volumetric displacement compared to that of hydraulic motor 33 discharges oil to conduit 40 at an increased pressure of between 600 psig and 2000 psig. Check valve 60 mounted in oil conduit 40 prevents flow of oil back through oil conduit 40 to hydraulic pump 36. High pressure oil from hydraulic pump 36 passes through high pressure oil conduit 40, through duplex filter 37, which functions to remove any foreign matter exceeding 5 microns in size, through high pressure oil conduit 40*a* and check valve 61 therein to proportional valve 7, and through high pressure oil conduit 40*b* which branches off conduit 40*a*. The high pressure oil flows from oil conduit 40*b* through accumulator safety relief manifold 41 to accumulator 38 where it is stored under pressure until released.

Accumulator 38 is designed to have a size, which is a function of a number of variables, between 5 to 40 gallons, preferably about 15 gallons, so that during what would be considered reasonable turbine operations the volume of oil stored therein is adequate to stroke turbine valve rack actuator 6 between 8 and 12 times, i.e. over the length of actuator cylinder 6*a*, preferably about 8 times, without the necessity of requiring substantial transient oil from hydraulic pump 36, for reasons hereinafter described. In addition, accumulator 38 is precharged with an inert pressurized gas, preferably nitrogen, at a pressure of between 600 psig and 1400 psig. Hydraulic pump 36 is designed to have a capacity of between about 0.1 gallons per minute to 3.0 gallons per minute, for adequate volumetric displacement to charge accumulator 38 in a minimal time period of a few minutes, e.g. about one to four minutes. Hydraulic motor 33 is designed with an output torque capability that matches the input torque requirements of the hydraulic pump 36 such that motor 33 stalls when accumulator 38 is fully charged. If accumulator 38 is not fully charged, hydraulic pump 36 continues to operate and direct oil thereto to replenish oil discharged during stroking operation. Accumulator safety relief manifold 41 in combination with pressure gauge 42 and pressure switch 43 provides overpressurization protection for the turbine valve rack actuator control system 30. Pressure switch 43 actuates for multiple purposes at a set pressure which is considered to be the minimum operating pressure of the high pressure oil system, i.e. about 700 psig. Oil for turbine valve rack actuator control system 30 is stored at maximum pressure of about 2000 psig in accumulator 38 until turbine valve rack actuator 6 is called upon to move the steam turbine rack valve assembly 5.

Proportional valve 7 directs high pressure oil to and from turbine valve rack actuator 6 to achieve and maintain the required actuator position. When high pressure oil in response to signals from closed loop speed control system 10 is directed through proportional valve port 7*a* it passes through conduit 8*a* to valve rack actuator cylinder upper end portion 6*b* which forces piston 6*d* and piston rod upper portion 6*e* to move downwardly causing turbine valve rack assembly 5 to reduce the flow of steam through steam inlet 3 and slow the speed of turbine 1. When high pressure oil in response to signals from closed loop speed control system 10 is directed through proportional valve port 7*b* it passes through conduit 8*b* to valve rack actuator cylinder lower portion 6*c* which forces piston 6*d* and piston rod upper portion 6*e* to move upwardly causing turbine valve rack assembly 5 to increase the flow of steam through steam inlet 3 and accelerate the speed of turbine 1. As piston 6*d* moves upward or downward, piston rod lower portion 6*f* also moves in the same direction, and this movement is transmitted to actuator position transducer 14.

Proportional valve 7 responds to closed loop speed control system 10 to operate turbine valve rack actuator 6. The closed loop speed control system 10 for the turbine valve rack actuator position cascades into the closed loop control circuit on the proportional valve spool position. The proportional valve 7 employs an integral Linear Variable Differential Transformer, i.e. LVDT, for valve spool position feedback and the turbine valve rack actuator 6 uses a linear position transducer 14 for feedback from turbine valve rack assembly 5. The actuator position feedback signal 21 is fed to the electronic amplifier 13 which also receives a cascaded signal generated by turbine speed controller 12. Turbine speed controller 12 determines actuator position command signal 19 to satisfy the turbine speed setpoint 15 compared to the actual speed of the turbine shaft 2. The turbine shaft speed is monitored and transmitted to the speed controller 12 by speed sensor(s) 11. When the turbine speed sensor(s) 11 detects an imbalance between the turbine shaft speed and the turbine speed setpoint 15, speed controller 12 signals the electronic controller/valve amplifier 13 to open or close the turbine valve rack 6 as required to bring the speed back to that desired, i.e. the setpoint signal from line 15.

In another variation of the invention the objectives are accomplished by a method of operating, described in simplified form, the above described system in the following manner.

Oil at a low pressure, i.e. between 20 psig and 200 psig, from source 31 is utilized to operate hydraulic motor 33, coupling 35, and hydraulic pump 36 to increase the pressure of the oil to a higher pressure, i.e. between 600 psig and 2000 psig. The high pressure oil is circulated from hydraulic pump 36 to proportional valve 7 and hydraulic oil accumulator 38, which is initially charged with an inert gas at a pressure between 600 psig and 2000 psig. The high pressure oil from hydraulic pump 36 is fed to hydraulic oil accumulator 38 until it is fully charged, compressing the inert gas therein until the pressure of the compressed gas and the volume of oil therein causes the high pressure of the oil to stall hydraulic motor 33, in the manner described above.

High pressure oil stored in hydraulic oil accumulator 38 is released, on demand, to proportional valve 7 and to turbine valve rack actuator 6 to stroke it and adjust turbine valve rack assembly 5 to control a flow of steam through steam inlet 3 to turbine 1 when a signal from the turbine closed loop speed control system 10 calls for a reduction or increase in the speed of turbine 1.

It is recognized that modifications and variations can be made by those skilled in the art to the above described system and method without departing from the spirit and scope thereof as defined in the appended claims.

I claim:

1. A system for regulating the speed of a turbine by operating a steam valve rack assembly to adjust the flow of steam to the turbine by controlling the position of the turbine valve rack actuator in response to oil within a first pressure range fed, reacting to signals from a closed loop speed control system, through a proportional valve to the turbine valve rack actuator comprising:

(A) a source of oil within a second pressure range lower than said first pressure range;

(B) oil accumulator; and (C) pressure intensifying means arranged to receive oil within the second pressure range from the oil source, increase the pressure thereof to within said first pressure range, and circulate the oil within the first pressure range to the oil accumulator and proportional valve;

whereby oil within said first pressure range released from the accumulator passes to and through the proportional valve to the valve rack actuator to close the valve rack assembly and reduce the flow of steam to said turbine when a signal from the closed loop speed control system calls for a reduction in the speed of said turbine and to open the valve rack assembly and increase the flow of steam to the turbine when a signal from the closed loop speed control system calls for an increase in the speed of the turbine.

2. The invention of claim 1 wherein oil within the first pressure range is between 600 psig and 2000 psig and oil within the second pressure range is between 20 psig and 200 psig.

3. The invention of claim 1 wherein the oil accumulator has a capacity of between 5 and 40 gallons and is pressurized by an inert gas.

4. The invention of claim 3 wherein the inert gas in the oil accumulator is pressurized to between 600 psig and 1400 psig.

5. The invention of claim 1 wherein the pressure intensifying means comprises:

(A) a hydraulic motor; and (B) a hydraulic pump.

6. The invention of claim 5 wherein the pressure intensifying means hydraulic pump has a capacity of between 0.1 gallons per minute and 3.0 gallons per minute.

7. The invention of claim 5 wherein the pressure intensifying means hydraulic motor has an output capability about equal to the input torque requirements of the hydraulic pump such that the hydraulic motor stalls when the accumulator is fully charged.

8. The invention of claim 1 wherein a velocity fuse is positioned between the source of oil and the pressure intensifying means.

9. The invention of claim 8 wherein the velocity fuse flow rate does not exceed 20 gallons per minute.

10. A system for regulating the speed of a turbine by operating the steam valve rack assembly to adjust the flow of steam to the turbine by controlling the position of the turbine valve rack actuator in response to oil within a first pressure range fed, reacting to signals from a closed loop speed control system, through a proportional valve to the valve rack actuator, comprising:

(A) a source of oil within a second pressure range lower than the first pressure range;

(B) an oil accumulator; and (C) pressure intensifying means arranged to receive oil within the second pressure range from the source, increase the pressure thereof to within the first pressure range, and circulate the oil within the first pressure range to the oil accumulator and the proportional valve;

(D) emergency stop valve system comprising (1) a first emergency stop valve;

(2) a second emergency stop valve; and (3) an emergency solenoid valve;

whereby in response to an external signal the emergency solenoid valve operates to dump oil within the first pressure range from the first and second emergency stop valves to an oil drain permitting the first and second emergency stop valves to open and allow oil within the first pressure range from the oil accumulator to flow through the first emergency stop valve to the first side of the turbine valve rack actuator and oil within the first pressure range to drain from the second side of the turbine valve rack actuator through the second emergency stop valve closing the turbine valve rack actuator and the steam valve rack assembly cutting off the supply of steam to the turbine.

11. The system of claim 10 wherein the pressure intensifying means comprises:

(A) a hydraulic motor; and (B) a hydraulic pump.

12. A method for regulating the speed of a turbine by operating a steam valve rack assembly to adjust the flow of steam to the turbine by controlling the position of the turbine valve rack actuator in response to oil within a first pressure range fed, reacting to signals from a closed loop speed control system, through a proportional valve to the the turbine valve rack actuator, comprising the steps of:

(A) utilizing oil within a second pressure range from a source thereof to operate pressure intensifying means to increase the pressure thereof within the first pressure range;

(B) circulating oil within the first pressure range to the proportional valve and to an oil accumulator containing inert gas within a third pressure range;

(C) continuing the circulation of oil within the first pressure range to the oil accumulator for storage therein whereby the pressure of the inert gas therein is equalized to within the first pressure range;

(D) releasing and transferring on demand at least a portion of the oil stored in the oil accumulator within the first pressure range to the proportional valve and to the turbine valve rack actuator to adjust the position thereof to control the flow of steam to the turbine when a signal from the closed loop speed control system calls for a reduction in the speed of the turbine and to open the turbine valve rack assembly and increase the flow of steam to the turbine when a signal from the closed loop speed control system calls for an increase in the speed of the turbine.

13. The method of claim 12 wherein oil within the first pressure range is between 600 psig and 2000 psig and oil within the second pressure range is between 20 psig and 200 psig.

14. The method of claim 12 wherein the pressure intensifying means comprises:

(A) a hydraulic motor; and (B) a hydraulic pump.

15. The method of claim 14 wherein the pressure intensifying means hydraulic pump has a capacity of between 0.1 gallons per minute and 3.0 gallons per minute.

16. The invention of claim 14 wherein a velocity fuse is positioned between the source of oil and the pressure intensifying means.

17. The invention of claim 16 wherein the velocity fuse flow rate does not exceed 20 gallons per minute.

18. The method of claim 12 wherein inert gas is first stored in the accumulator at a third pressure between 600 psig and 1400 psig.

19. The method of claim 12 wherein the oil accumulator has a capacity of between 5 and 40 gallons and is pressurized by an inert gas.

20. The method of claim 12 wherein the inert gas in the oil accumulator is first pressurized to between 600 psig and 1400 psi.

* * * * *